US005286178A

United States Patent [19]

Schaef

[11] Patent Number: 5,286,178

[45] Date of Patent: Feb. 15, 1994

[54] FUEL INJECTION PUMP FOR INTERNAL COMBUSTION ENGINES

[75] Inventor: Wolfgang Schaef, Stuttgart, Fed. Rep. of Germany

[73] Assignee: Robert Bosch GmbH, Stuttgart, Fed. Rep. of Germany

[21] Appl. No.: 26,796

[22] Filed: Mar. 5, 1993

[30] Foreign Application Priority Data

Mar. 5, 1992 [DE] Fed. Rep. of Germany .... 4206883.5

[51] Int. Cl.[5] ..... F04B 7/04

[52] U.S. Cl. ..... 417/490; 417/499; 123/299; 123/507

[58] Field of Search ..... 417/490, 494, 499; 123/299, 507

[56] References Cited

U.S. PATENT DOCUMENTS

| | | | |
|---|---|---|---|
| 4,023,916 | 5/1977 | Indra | 417/499 |
| 4,611,566 | 9/1986 | Kampichler et al. | 417/499 |
| 4,824,341 | 4/1989 | Augustin | 417/499 |
| 4,897,024 | 1/1990 | Hatz et al. | 417/494 |
| 4,957,418 | 9/1990 | Pischinger et al. | 123/299 |
| 4,975,029 | 12/1990 | Hatz | 123/299 |
| 5,209,208 | 5/1993 | Siebert et al. | 123/299 X |

FOREIGN PATENT DOCUMENTS

| | | | |
|---|---|---|---|
| 0269610 | 6/1988 | European Pat. Off. | 417/499 |
| 3926166 | 2/1991 | Fed. Rep. of Germany . | |

*Primary Examiner*—Richard A. Bertsch
*Assistant Examiner*—Michael I. Kocharov
*Attorney, Agent, or Firm*—Edwin E. Greigg; Ronald E. Greigg

[57] ABSTRACT

A fuel injection pump for internal combustion engines, having a pump piston that is guided axially and rotationally movably in a cylinder bore of a cylinder liner and that with a face end defines a pump work chamber. The fuel injection pump pumps a quantity of fuel that is divided into a preinjection quantity and a main injection quantity. On a jacket face, this pump piston has known oblique grooves for the high-pressure pumping diversion process, and also a recess, which cooperates with an annular groove in the cylinder bore and with a control opening which discharges into a low-pressure chamber, and on its end face the piston has a cutout formed by two different, deep shoulders; the cutout is recessed within the annular groove continuously and cooperates with a first control opening that discharges into the low-pressure chamber. During the high-pressure pumping phase, depending on the rotary position of the pump piston, the pump work chamber can be relieved via the annular groove, the recess, and the control opening; this interruption in high-pressure pumping can be limited to the partial-load or the full-load range, depending on the embodiment.

13 Claims, 3 Drawing Sheets

FUEL INJECTION PUMP FOR INTERNAL COMBUSTION ENGINES

BACKGROUND OF THE INVENTION

The invention is based on a fuel injection pump as defined hereinafter. In a fuel injection pump of this type, known from German Offenlegungsschrift 39 26 166, the fuel injection quantity is divided into a preinjection quantity and a main injection quantity during the high-pressure pumping. This provision makes it possible to decrease the prestorage of uncombusted fuel during the ignition delay and accordingly to avoid overly high pressure peaks in the combustion chamber upon sudden combustion of the prestored fuel, which in turn lessens the thermal and mechanical strain on the engine and lowers the noise it produces.

For these purposes, the known fuel injection pump, which includes a pump piston that for adjusting the injection quantity is guided axially movably and rotatably in a cylinder liner and whose end face defines a pump work chamber that can be made to communicate, via a conduit in the pump piston and two control openings in the cylinder liner, with a low-pressure chamber that surrounds the cylinder liner and forms a suction chamber, is provided with an annular groove in the inner wall of the cylinder liner, above the control openings, on the side toward the pump work chamber. This annular groove cooperates with a recess, which in addition to the usual control recesses is disposed on the jacket face of the pump piston and is defined on all sides by the pump piston jacket face, and also cooperates with a stepped end face of the pump piston that determines the supply onset; beginning at the stepped end face, a longitudinal groove on the pump piston jacket face discharges directly into the annular groove, while the axial length of the recess enables communication during a portion of the piston stroke between the annular groove in the cylinder liner and one of the control openings, with which it cooperates via control edges. Via this communication, during a portion of the supply stroke, the fuel, which is at high pressure, can flow out of the pump work chamber into the low-pressure chamber, resulting in a brief pressure relief in the pump work chamber that in turn causes an interruption in the injection process.

With this arrangement, however, only a constant preinjection onset, a constant preinjection quantity, and a constant pumping interval between the preinjection and the main injection are possible. It is also already known to provide a load- or rpm-dependent shift in injection onset in fuel injection pumps, with the aid of structural provisions at the pump piston, such as chambers on its end, or with reciprocating slides that are axially displaceable on the pump piston. However, to achieve an optimal course of combustion, in terms of noise abatement on the one hand and emission and fuel consumption figures on the other, the injection onset, the preinjection quantity and the injection or pumping interval between the preinjection and main injection must all be optimized as a function of both load and rpm; thus the known fuel injection pump is unable to meet the stringent demands made of a modern internal combustion engine.

OBJECT AND SUMMARY OF THE INVENTION

The fuel injection pump according to the invention has an advantage that both the preinjection and a load-dependent shift in the injection onset can be achieved with a pump element; the embodiment of the invention does not need any additional components compared with the known fuel injection pump.

Advantageously, as provided hereinafter, a further deepened cutout is made in the recessed end face of the pump piston, at the level of the maximum supply quantity position, which is determined by the oblique groove; as a result, preinjection in the low load range remains possible, while in the middle and high ranges preinjection is omitted and the injection onset is retarded.

In order for the injection not be subdivided into a preinjection quantity and a main injection quantity until full load, one provision of the invention disposes an elevated segment on the recessed end face of a pump piston at the level of the minimum fuel supply quantity. To that end, the recess on the pump piston by which the annular groove in the pump cylinder communicates with the control opening is shortened such that it does not overtake the control opening in the low load range. In this way, the preinjection can remain restricted to the full load range without additional components, while in the middle load range the injection onset is retarded.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
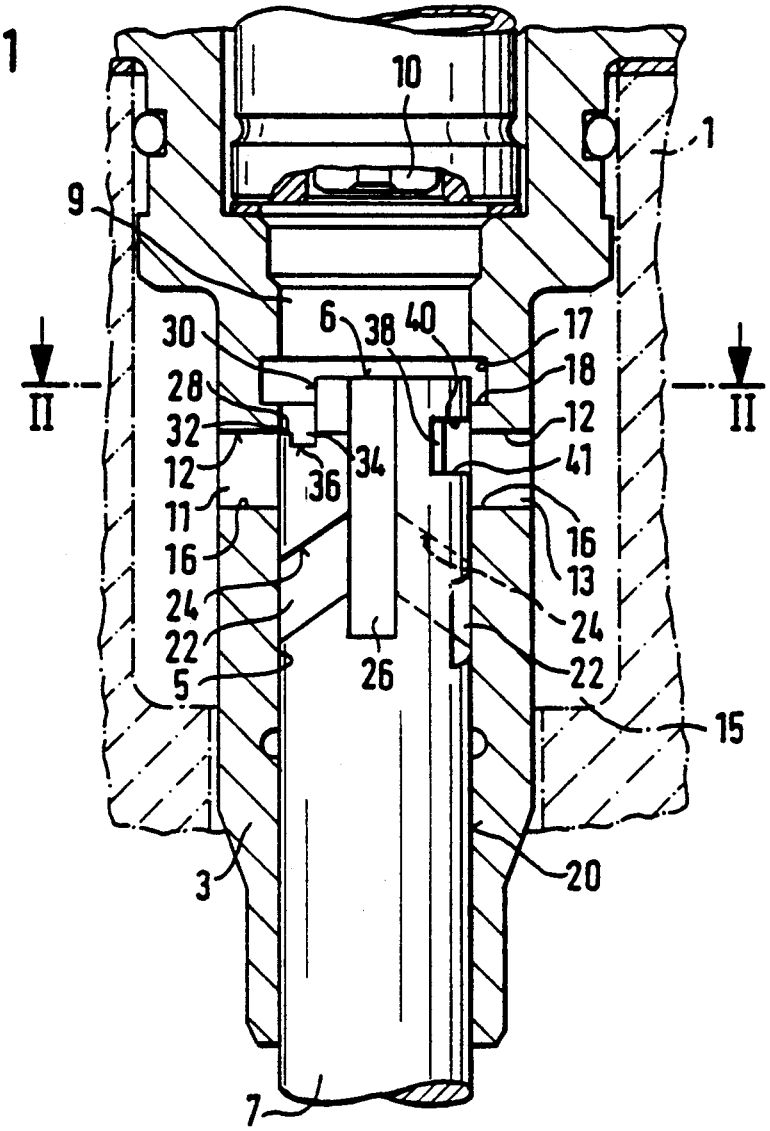
FIG. 1 is a longitudinal section through the portion essential to the invention of a pump element of a fuel injection pump embodied for preinjection and main injection with the pump piston shown in the supply onset position.
Figure 2:
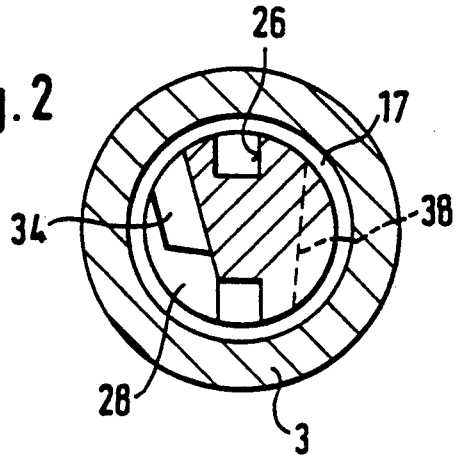
FIG. 2 is a cross section taken along the line II—II of FIG. 1.
Figure 3:
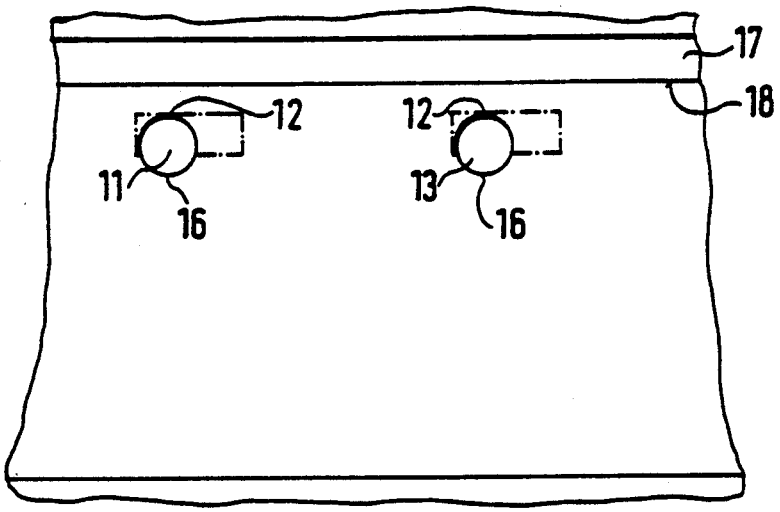
FIG. 3 is a developed view of the inner wall of the pump cylinder.

In the fuel injection pump shown in FIG. 1 only in its region essential to the invention, one of a plurality of cylinder liners 3 inserted into a pump housing 1 is shown; each cylinder liner has a cylinder bore 5, in which a pump piston 7, which in the cylinder bore 5 with its end face 6 defines a pump work chamber 9, is axially moved by a cam drive, not shown, and rotated via a governor rod, likewise not shown, for injection timing adjustment. The pump work chamber 9 communicates in turn via an injection line (not shown) in which a pressure valve 10 is disposed, with an injection valve protruding into a combustion chamber of the internal combustion engine to be supplied. The pump work chamber 9 additionally communicates with a low-pressure chamber 15, acting simultaneously as a suction chamber and a return chamber and formed by a recess in the pump housing 1, at certain pump piston positions, via two diametrically opposed control openings, embodied as through bores and acting simultaneously as suction and return openings, which form a left control opening 11 and a right control openings 13 in the cylinder liner 3. The ends of the control openings 11 and 13 form one upper control edge 12, oriented toward the pump work chamber 9, and one lower control edge 16, remote from the pump work chamber 9. The fuel, put at inflow pressure by a prefeed pump, is pumped into the low-pressure chamber 15 via a fuel feed line, not shown in detail. Besides the control openings 11, 13, an annular groove 17 is machined into the inner wall face of the cylinder liner 3 on the upper side of the control openings 11, 13 oriented toward the pump work chamber 9; the lower limiting edge, remote from the pump work chamber 9, of this annular groove forms a horizontal control edge 18. Two recesses offset from one another by 180° and embodied by oblique grooves 22 are machined into the jacket face 20 of the pump piston 7; together with the jacket face 20 of the pump piston 7, the boundary toward the pump work chamber 9 of each of these recesses forms one oblique control edge 24. The oblique grooves 22 communicate continuously with the pump work chamber 9, each via a respective stop groove 26 which is machined in the form of a longitudinal groove into the pump piston 7. To control a fuel quantity divided into a preinjection quantity and a main injection quantity, the pump piston 7, in a region cooperating with the left control opening 11, has a shoulder 28, beginning at the end face 6 of the pump piston 7 toward the pump work chamber and offset from that end face; in the otherwise horizontal boundary edge between the end face 6 and the jacket face 20, this shoulder forms a cutout 30, which is defined on the pump piston drive side by a first horizontal control edge 32 located at a lower level and cooperating with the left control opening 11; in the supply onset position shown of the pump piston 7, this control edge 32, by overtaking the upper control edge 12 of the control opening 11, closes the communication between the pump work chamber 9 and the left control opening 11. The other end edge of the face end 6 has at that time already overtaken the right control opening 13 in the direction of the pump work chamber 9. In addition, an indentation 34 (see FIGS. 4 and 7) is machined into the face of the first shoulder 28 of the cutout 30; the boundary of this indentation, together with the jacket face 20 of the pump piston 7, defines the second horizontal control edge 36. Approximately diametrically opposite to the cutout 30, in the region of the jacket face 20 of the pump piston 7 controlled by the right control opening 13, there is a recess 38 in the form of a rectangular pocket, whose vertical boundaries form two horizontal control edges, of which an upper control edge 40, which is closer to the pump work chamber 9, cooperates with the lower control edge 18 of the annular groove 17, and a lower control edge 41, farther away from the pump work chamber 9, cooperates with the upper control edge 12 of the right control opening 13. The vertical length of the recess 38 is great enough that it is longer than the distance between the lower control edge 18 of the annular groove 17 and the upper control edge 12 of the right control opening 13, so that the recess 38 establishes communication between the annular groove 17 and the right control opening 13 during a portion of the pump piston stroke. For that purpose, the recess 38 is located, viewed in the direction of the longitudinal piston axis, between the end face 6 and the oblique groove 22 that cooperates with the right control opening 13. The distance between the upper control edge 40 and the end face 6 of the pump piston 7 is then less than the axial length of the annular groove 17, and the difference between these distances determines the stroke of the pump piston 7 over which the pump work chamber 9, following the preinjection, is relieved until the onset of the main injection. The form and location of the recess 38 and of the cutout 30 can be seen in FIG. 2 and in FIGS. 4 and 5. FIG. 3, in a developed view of the inner wall of the cylinder liner 3, shows the location of the control openings 11 and 13 and of the annular groove 17.

Figure 4:
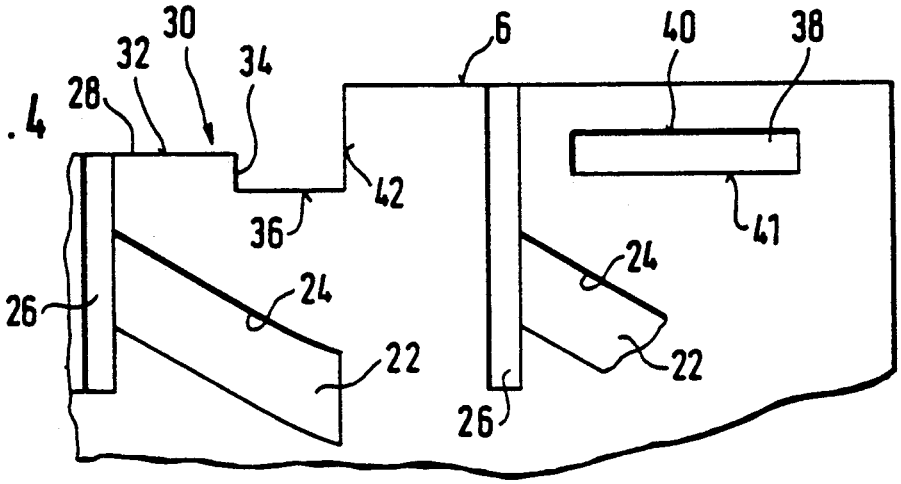
FIG. 4 is a developed view of the pump piston according to the invention, in a first variant embodiment in which the preinjection takes place only in the low load range.

The developed view of the pump piston 7 shown in FIG. 4 shows a first exemplary embodiment that has already been shown in FIG. 1, in which the indentation 34 is made in the region of the cutout 30. This indentation 34 borders directly on a vertical edge 42, which is remote from the stop groove 26 cooperating with the left control opening 11 and defines the cutout 30 and is accordingly located in the region of the piston jacket face that corresponds to the maximum supply quantity, or in other words the region in which the axial distance between the oblique groove 22 and the plane of the remaining end face 6 is the greatest. The horizontal face bordering on the jacket face 20 of the pump piston 7 forms the second control edge 36, which cooperates with the upper control edge 12 of the left control opening 11. The recess 38, which is approximately diametrically opposite the cutout 30, has a length in the circumferential direction, in the first exemplary embodiment, with which it overtakes the right control opening 13 during a portion of the pump piston stroke, in any rotary position of the pump piston 7.

Figure 5:
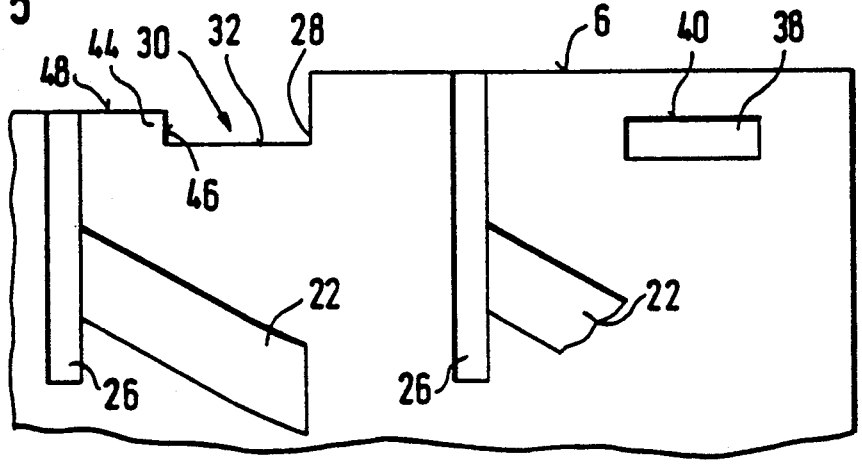
FIG. 5 is a developed view similar to FIG. 4 for a second exemplary embodiment of the pump piston according to the invention, in which the preinjection takes place in the high load range.

The second exemplary embodiment, shown in FIG. 5, differs from the first embodiment shown in FIG. 4 only in the form of the cutout 30 and the length of the recess 38. Inside the cutout 30, instead of an indentation, there is now a protuberance 44 of the shoulder 28 in the region of the piston jacket face; this protuberance is associated with the left control opening 11 at a minimum supply quantity. Via an edge 46 disposed at right angles to the end face 6, the protuberance 44 borders the shoulder 28 and extends as far as the left stop groove 26 cooperating with the left control opening 11; the boundary to the jacket face 20 of the pump piston 7 is embodied as a horizontal control edge 48. Compared with FIG. 4, the recess 38 is shortened and extends only so far in the circumferential direction of the pump piston 7 that in the rotary position of the pump piston relative to the right control opening 13, corresponding to a minimal or average supply quantity, it does not overtake the right control opening 13, which accordingly remains closed by the jacket face of the pump piston 7. The protuberance 44 accordingly has the effect of advancing the injection, which is now no longer subdivided, because the left control opening 11 is closed earlier at low load than at a higher load in which a preinjection is involved.

The mode of operation of the fuel injection pump according to the invention will now be described in conjunction with FIGS. 1, 6 and 7.

Figure 7:
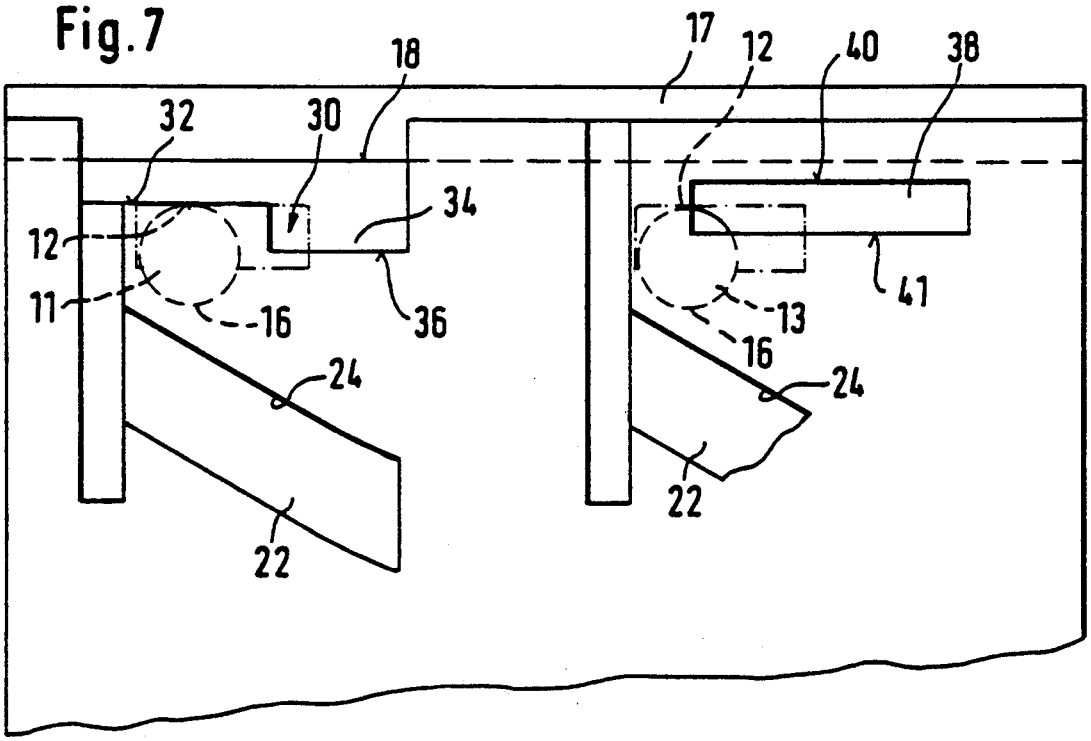
FIG. 7, analogously to FIG. 6, shows a further function diagram in which the pump piston of FIG. 4 is shown in the supply onset position for preinjection in the low load range.

As already noted, the pump piston 7 in FIG. 1 and in the diagram of FIG. 7 corresponding to it is in its position or stroke location that initiates the preinjection, following a preliminary stroke traversed in a known manner until the closure of the control opening 11 by the overtaking of the upper control edge 12 of the control opening 11 by the first control edge 32. In this piston position, the pump work chamber 9 is completely closed off, and in the course of the further piston stroke, the preinjection is effected via the pressure valve 10 and the injection line to the engine. After a relatively short piston stroke, which corresponds to the distance between the control edge 32 of the pump piston 7 and the upper control edge 40 of the recess 38, the control edge 40 overtakes the lower control edge 18 of the annular groove 17, while the lower control edge 41 of the recess 38 is still located in the region of the right control opening 13. A fuel, which is now at high pressure, flows via this opening cross section out of the pump work chamber 9 via the annular groove 17, the recess 38 and the right control opening 13, into the low-pressure chamber 15; the pressure in the pump work chamber 9 drops below the necessary injection pressure, and the high-pressure pumping is interrupted. As the piston stroke continues, the control edge 6, formed by the end face 6 of the pump piston 7, overtakes the upper boundary edge of the annular groove 17, thereby interrupting the communication between the pump work chamber 9 and the right control opening 13, and the high-pressure pumping continues until it is terminated in a known manner by the overtaking of the lower control edges 16 of the control openings 11, 13, by the upper control edges 24 of the oblique grooves 22. It is also possible, however, to dimension the axial height of the recess 38 such that it is greater, by the length of the relief stroke of the pump piston 7, than the axis distance between the lower edge 18 of the annular groove and the upper edge 12 of the control opening 13. The annular groove 17 is wider than the axis height of the recess 38, minus the axial distance between the lower edge 18 of the annular groove and the upper edge 12 of the control opening.

The embodiment of the cutout 30 of the pump piston 7 according to the invention has the advantage in the first exemplary embodiment that in the low load range, or in other words with a small supply quantity, the above-described preinjection takes place, while in the middle and high load range, which is achieved by rotation of the pump piston 7 in the direction of an increased supply quantity, the preinjection is omitted.

In the transitional range at medium load, a partial overtaking of the indentation 34 via the left control opening 11 takes place, so that the supply onset in this load range, with increasing supply quantity, is retarded, in cooperation between the control edge 36 of the indentation 34 and the control edge 12 of the left control opening 11 and between the control edge 41 of the recess 38 and the control edge 12 of the right control opening 13. Accordingly, beyond an arbitrarily selectable load range, the preinjection is omitted. In the upper load range, the entire preinjection is omitted, since the pump work chamber is not closed by the control edge 36 until the communication between the right control opening 13 and the pump work chamber 9 has been interrupted. The supply onset is then determined by the instant that the control edge 36 overtakes the upper control edge 12 of the left control opening 11; the supply onset is then retarded by the interval between the preinjection and the main injection. The loss of a useful piston stroke involved in retarding the injection onset and the omission of the preinjection quantity might have to be compensated for by increasing the inclination of the oblique groove.

Figure 6:
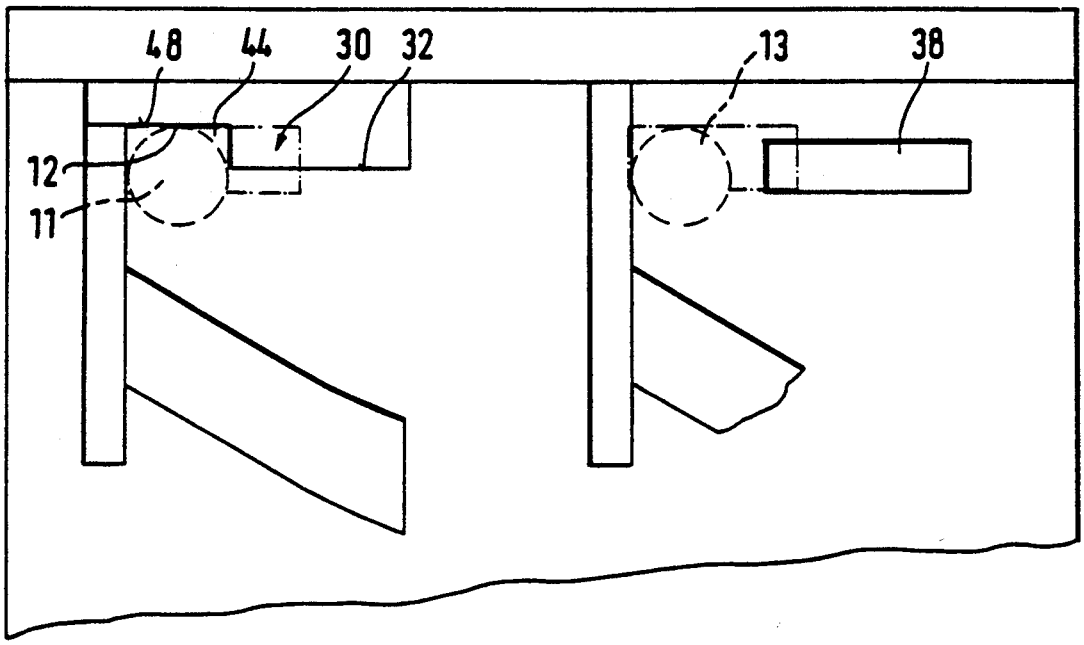
FIG. 6 is a function diagram in which the pump piston of FIG. 5 slides in the pump cylinder, shown in the supply onset position in the low load range.

To explain the second exemplary embodiment, shown in FIG. 5, this embodiment is shown in the diagram of FIG. 6 at the instant of supply onset. Analogously to the function of the first exemplary embodiment, the communication between the pump work chamber 9 and the low-pressure chamber 15 is interrupted by the overtaking of the upper control edge 12 of the left control opening 11 by the control edge 48 of the protuberance 34 in the cutout 30; the pressure required for injection is attained in the further piston stroke and injection into the combustion chamber of the engine occurs. In the region of the pump piston location shown in FIG. 6, which corresponds to a minimum supply quantity, the high-pressure pumping is not divided into a preinjection and a main injection, because in this pump piston location the recess 38 does not overtake the right control opening 13. In the middle load range, because the protuberance 44 only partly overtakes the left control opening 11, retardation of the injection onset occurs, and in the high load range, or in other words the range of maximum supply quantity, the recess 38 again fully overtakes the right control opening 13, and similarly to the function of the first exemplary embodiment in the low load range, an interruption in high-pressure pumping now takes place in the full load range, by means of the brief pressure relief of the pump work chamber 9 via the recess 38 and the right control opening 13 into the low-pressure chamber 15. In this exemplary embodiment as well, the loss of a useful stroke from the retardation of the injection onset and the injection interval must be compensated for by a greater inclination of the element.

With the two exemplary embodiments described, a load-dependent shift of the injection onset in combination with a preinjection is accordingly possible with only a single injection pump element; as needed, this preinjection can be shifted to the upper or lower load range.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a pump piston (7), guided axially and rotationally movably in a cylinder bore (5), said pump piston includes an end face (6) which defines a pump work chamber (9), the pump piston having on a jacket face (20) two oppositely disposed recesses (22), which communicate with the pump work chamber (9) through at least one conduit (26), each recess has an upper oblique control edge (24) extending at a predetermined angle to the circumferential direction of the pump piston (7), the control edges (24) cooperate with two opposed control openings (11 and 13) in a wall of the cylinder bore (5) that lead to a low-pressure chamber (15), an encompassing annular groove (17) in the wall of the cylinder bore (5) is located above the control openings (11) toward the pump work chamber, the annular groove (17) communicates during a partial stroke of the pump piston (7) with one of the control openings (13) and simultaneously with the pump work chamber (9) by means of a recess (38) in the jacket face (20) of the pump piston (7) that is defined on all sides by the pump piston jacket face (20), and a cutout (30) of the pump piston (7), which during a portion of the pump piston stroke connects the pump work chamber (9) to the control opening (11), said cutout (30) is formed by a shoulder (28) that is recessed relative to the end face (6) of the pump piston (7) toward the pump work chamber, the boundary edge of said control opening (11) is cutout toward the pump piston jacket face (20) to form a control edge (32), by which the control opening (11) is closable earlier during the pump piston supply stroke than when the recess (38) establishes a communication between the annular groove (17) and the control opening (13), the cutout (30) of the end face (6) of the pump piston (7) has a second shoulder in the end face (6) in an axial alignment with one of the oblique grooves (22).

2. A fuel injection pump as defined by claim 1, in which the second shoulder, disposed in the cutout (30), is formed by an indentation (34) in the end face (6) of the pump piston (7).

3. A fuel injection pump as defined by claim 2, in which the indentation (34) has a rectangular cross section and is located with an outlet at the jacket face (20) in the axial alignment with the portions of the oblique control edges (24), said edges being spaced apart by the greatest axial distance from the plane of the remaining end faces of the cutout (30).

4. A fuel injection pump as defined by claim 3, in which the horizontal faces of the cutout (30) form horizontal control edges (32, 36, 48), which depending on the rotary position of the pump piston (7) cooperate with an upper control edge (12) of the control opening (11) for the sake of controlling the injection onset.

5. A fuel injection pump as defined by claim 2, in which the horizontal faces of the cutout (30) form horizontal control edges (32, 36, 48), which depending on the rotary position of the pump piston (7) cooperate with an upper control edge (12) of the control opening (11) for the sake of controlling the injection onset.

6. A fuel injection pump as defined by claim 2, in which the second shoulder disposed in the cutout (30) is formed by a protuberance (44) on the end face (6) of the pump piston (7), and its transition to the jacket face (20) is located in the axial alignment of the portions of one of the oblique control edges (24) that are spaced apart by the shortest axial distance from a horizontal plane of the remaining end face of the cutout (30), and that the recess (38) extends in a horizontal circumferential direction only far enough that, at the piston position of minimal distance between the oblique groove (22) and the end face (6), the recess does not overtake the control opening (13) that cooperates with it.

7. A fuel injection pump as defined by claim 6, in which the protuberance (44) has a rectangular cross section.

8. A fuel injection pump as defined by claim 7, in which the horizontal faces of the cutout (30) form horizontal control edges (32, 36, 48), which depending on the rotary position of the pump piston (7) cooperate with an upper control edge (12) of the control opening (11) for the sake of controlling the injection onset.

9. A fuel injection pump as defined by claim 6, in which the horizontal faces of the cutout (30) form horizontal control edges (32, 36, 48), which depending on the rotary position of the pump piston (7) cooperate with an upper control edge (12) of the control opening (11) for the sake of controlling the injection onset.

10. A fuel injection pump as defined by claim 1, in which the horizontal faces of the cutout (30) form horizontal control edges (32, 36, 48), which depending on the rotary position of the pump piston (7) cooperate with an upper control edge (12) of the control opening (11) for the sake of controlling the injection onset.

11. A fuel injection pump as defined by claim 1, in which on the pump piston (7), the upper, horizontal edge of the recess (38) oriented toward the pump work chamber (9) forms an upper control edge (40) that controls the end of supply for the preinjection.

12. A fuel injection pump as defined by claim 11, in which the lower, horizontal edge of the recess (38), remote from the pump work chamber (9), forms a lower control edge (41) that cooperates with the upper control edge (12) of the control opening (13).

13. A fuel injection pump as defined by claim 1, in which the lower, horizontal edge of the annular groove (17), remote from the work chamber (9), is embodied as a control edge (18) that cooperates with the upper control edge (12) of the control opening (13).

* * * * *